US007401366B1

(12) United States Patent
Costa

(10) Patent No.: US 7,401,366 B1
(45) Date of Patent: Jul. 22, 2008

(54) CHILDREN'S PLAY YARD AND ELASTIC, REMOVABLE LINER

(76) Inventor: Allison Costa, 3782 Berry Dr., Studio City, CA (US) 91604

( * ) Notice: Subject to any disclaimer, the term of this patent is extended or adjusted under 35 U.S.C. 154(b) by 0 days.

(21) Appl. No.: 11/677,023

(22) Filed: Feb. 20, 2007

(51) Int. Cl.
*A47D 7/00* (2006.01)
*A47D 15/00* (2006.01)
*A47D 13/06* (2006.01)

(52) U.S. Cl. ..... 5/93.1; 5/98.1; 5/658; 5/663; 220/495.11

(58) Field of Classification Search ..... 5/93.1, 5/98.1, 99.1, 424, 427, 663, 946; 220/495.01, 220/495.11; 229/117.35
See application file for complete search history.

(56) References Cited

U.S. PATENT DOCUMENTS 2,025,613 A * 12/1935 Rohan ..... 5/93.1
2,128,978 A * 9/1938 Akin ..... 5/93.1
2,566,790 A * 9/1951 Bloomfield ..... 5/93.1
3,103,669 A * 9/1963 Mundis ..... 5/98.1
5,163,191 A * 11/1992 Chan ..... 5/98.1
5,941,408 A * 8/1999 Sherman ..... 220/495.01
6,421,857 B2 * 7/2002 Whatman et al. ..... 5/663
6,687,927 B1 * 2/2004 Tharalson et al. ..... 5/98.1
6,895,611 B2 * 5/2005 Tharalson et al. ..... 5/99.1

* cited by examiner

*Primary Examiner*—Alexander Grosz
(74) *Attorney, Agent, or Firm*—Marc E. Hankin; Hankin Patent Law, APC

(57) ABSTRACT

Various embodiments of the invention are directed towards a baby play yard cover or lining that lines the walls and floor of a baby play yard in order that the play yard is protected from soiling by the baby. Various embodiments of the invention are re-attachable such that the play yard liner may be washed separately from the play yard. The play yard cover has a plurality of elastic reinforcing portions which facilitate the securing of the cover to its corresponding play yard.

9 Claims, 3 Drawing Sheets

CHILDREN'S PLAY YARD AND ELASTIC, REMOVABLE LINER

FIELD OF INVENTION

Various embodiments of this invention relate, generally, to children's play yards; more particularly, to liners for children's play yards.

BACKGROUND

Baby's and children's play yards, cribs, bassinets, and cradles often utilize accessory covers in order to improve the safety and enjoyment of the child and the convenience to the parents. U.S. Pat. No. 3,103,669, for example, discloses a crib safety shield that surrounds the side panels of a baby crib in order to protect the baby while in the crib. This basic type of crib safety shield operates to protect the child from slipping through openings of the crib, prevent children outside of the crib from touching the child within the crib, and prevents toys and other items from slipping out of the crib.

Another such device is disclosed by U.S. Pat. No. 5,941,408 to Sherman. Sherman's patent discloses a container liner with integral handle cover that is directed towards lining the inside of a container while providing a flap that extends beyond the edges of the handle in order to wrap around the container's handle. While Sherman's patent discloses a device that lines the inner portion of a container, it fails to disclose a device that operates to also line the exterior of the container.

Another such device is disclosed by U.S. Pat. No. 2,566,790 to Bloomfield. Bloomfield's patent discloses a crib cover that protects the interior of the crib from drafts or cold. The system improves upon the above patents by disclosing a combined inner and outer cover and lining that attaches at the four sides of the crib to a bottom lining. In this manner, Bloomfield's invention serves to seal the interior of the crib from drafts that may enter from the side of bottom of the crib.

Another such device is disclosed by U.S. Pat. No. 2,025,613 to Rohan. Rohan's patent discloses a baby carriage protector that provides sanitary protection to the carriage while protecting the body of the infant while in the carriage. Rohan's device comprises a water-proof lining for the carriage that features an elastic edge lining to wrap around the edges of the crib and attach the lining to the carriage.

Another such device is disclosed by U.S. Pat. No. 6,421,857 to Whatman et al., which discloses a liner for an infant bed. Whatman's patent discloses a baby crib liner that attaches to the top rails of the baby crib in order to prevent the baby from passing through the walls of the baby crib. Whatman's device features breathable or mesh side walls in order that the baby may receive fresh air and be viewed from outside the crib.

Another such baby crib cover is disclosed by U.S. Pat. No. 2,128,978 to Akin. Akin's cover features a bottom platform and four side walls that serve to protect the crib from soiling by the baby. Akin's cover attaches to the crib by a series of straps that attach the vertical portions of the cover to the crib. The cover further features a zipper at each of the joints between the vertical flaps in order that, when applied to a crib, all sides of the crib are protected.

Yet another such device is disclosed by U.S. Pat. No. 5,163,191 to Chan, which discloses a replaceable two-level crib drape. Chan's device comprises a main drape and upper drape wherein the main drape surrounds the bottom portion of the crib walls and the upper drape rests atop the main drape and surrounds the upper portion of the drape walls. A series of zippers is used in order to attach the various portions of the drapes.

A toy storage cover for portable play yards is disclosed by U.S. Pat. Nos. 6,687,927 and 6,895,611, both to Tharalson et al. Tharalson's patents disclose a toy storage cover that includes four outer panels shaped to surround the outer walls of a play yard and a bottom panel that is used to serve as a mattress pad at the base of the play yard. In this manner, Tharalson's device is directed towards converting a play yard into a toy storage container. In various embodiments of Tharalson's invention, the invention also features pockets along the outside of the cover, such that additional toys may be stored in the pockets along the outside of the cover.

The above devices disclose varying means for covering baby play yards, cribs, and bassinets. While many of the above devices protect a baby from falling out of a crib, they are not directed towards protecting the crib from soiling. Meanwhile, while other devices cover baby play yards, none of these devices are directed towards providing a liner to baby play yards such that the baby may play in a play yard that features the liner, babies may soil the liner, and the liner may be removed for washing. Thus, their remains a long felt need in the art for a play yard liner that protects the play yard while allowing babies and children to play inside the play yard.

SUMMARY OF THE INVENTION

Various embodiments of the invention are directed towards overcoming the above shortcomings by disclosing a play yard liner that allows babies to play inside the lined play yard while also protecting the play yard from soiling by the babies. Thus, the liner may be separately replaced or washed from the play yard.

Various embodiments of the invention are directed towards a liner that operates to surround the walls and base of a play yard. The liner comprises a bottom surface liner, whose outer surface covers the bottom surface of the play yard. The bottom surface liner may be comprised of any of the various washable or stain resistant materials known in the art. The bottom surface liner serves to protect the bottom surface of the play yard and attaches to the four wall liners.

Various embodiments of the invention further feature wall liners that serve to protect the walls of the play yard. The wall liners comprise a series of liners that attach to the bottom surface liner. The wall liners are shaped generally the same size as that of the play yard walls and wrap around the play yard walls. The wall liners feature an inner liner, that lines the inner walls, and an outer liner, that lines the outer walls. The wall liners are comprised of a plurality of materials. The edges of the wall liners are comprised of a washable or stain resistant material that is not transparent. The center portions of the walls are comprised of a mesh material, which allows parents to view babies while they are within the play yard.

In order to attach the various portions of the play yard liner to one another and help attach the play yard liner to a play yard, various embodiments of the play yard liner feature a plurality of reinforcing sections. In various embodiments of the invention, the play yard liner features an upper reinforcing section that circumscribes the top of the play yard. In various embodiments of the invention, the upper reinforcing section comprises an elastic material, in order that the upper reinforcing section attaches the liner to the play yard. In various embodiments of the invention, the liner further features vertical reinforcing sections that support the liner at areas adjacent to the play yard columns. In various embodiments of the invention, the liner further features a bottom reinforcing portion that surrounds the inner portion of the liner at the portions where the wall liners meet the bottom liner. The various reinforcing sections or portions comprise an elastic material, which facilitates the secure attachment of the liner to its corresponding play yard.

In various embodiments of the invention, the liner also features a plurality of straps in order to attach the liner to the play yard. In one embodiment of the invention, the plurality of straps are located at the base of the outside of the wall liner adjacent to the play yard's support columns. In various embodiments of the invention, the straps are configured to attach to the support columns by buttons, hooks, fasteners, hook-and-loop fasteners, and other such attachment systems known in the art.

It should be noted that various embodiments of the invention may be removed from the play yard and washed separately from the play yard. In this manner, the liner allows babies to enjoy the play yard without worry that in soiling the play yard, the play yard would be ruined. Thus, a soiled play yard liner may be washed, for example, in a washing machine and reattached to the play yard. In this manner, the liner extends the lifetime of the play yard and allows parents to maintain a clean play area for their babies.

It further remains within the contemplation of the invention to be used with a variety of play yards, play yards of different shapes, cribs, bassinets, and further such baby enclosures known in the art. In further remains within the contemplation to be used with a variety of materials known in the art for constructing baby products.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive. Also, the reference or non-reference to a particular embodiment of the invention should not be interpreted as a limit on the scope of the invention.

In the following description, certain terminology is used to describe certain features of one or more embodiments of the invention. For instance, "play yard" refers to any child's play yard, playard, crib, bassinet, cradle, or other such space enclosed in walls for holding children and babies; "mesh" refers to any transparent or semi-transparent garment material.

Figure 1:
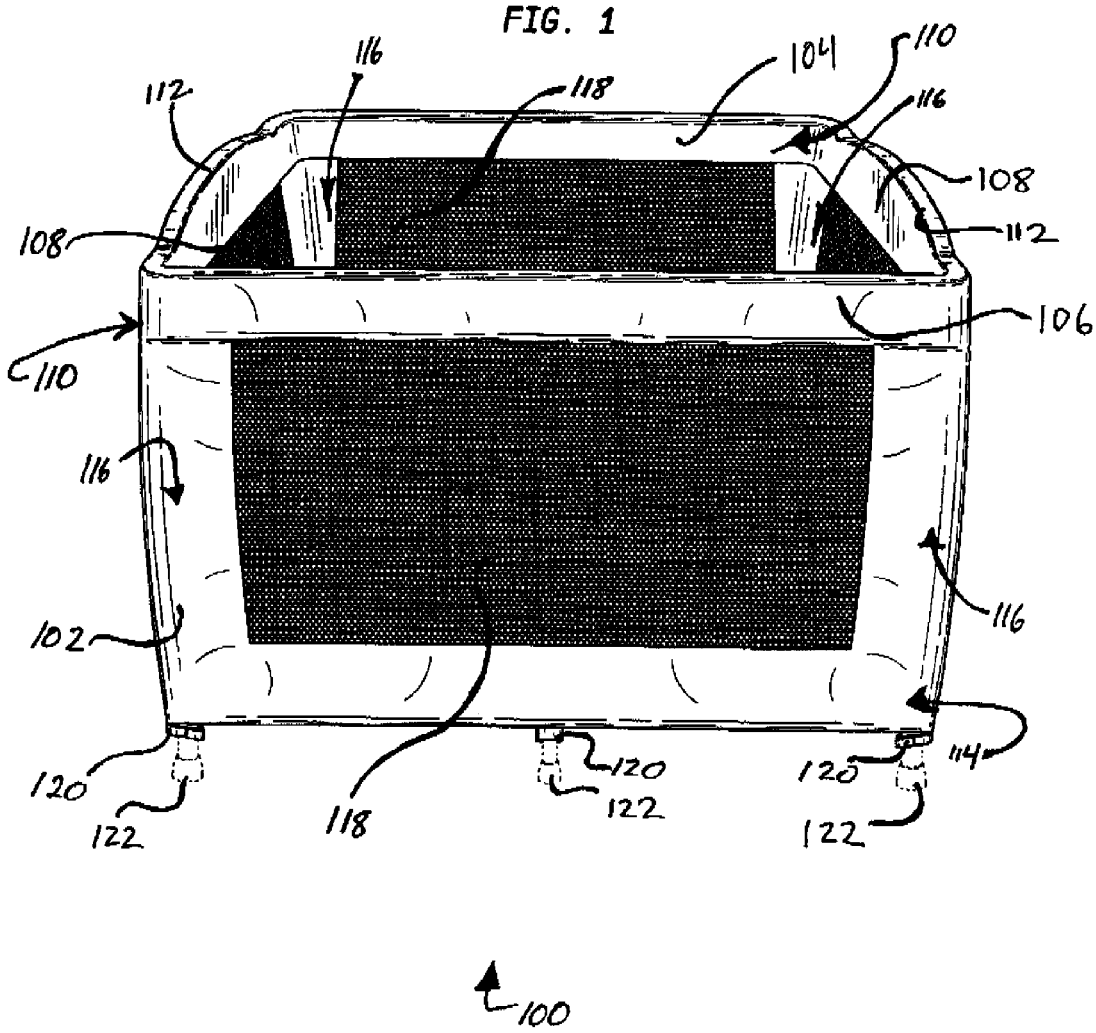
FIG. 1 is an illustration from a perspective view of one embodiment of the invention.

FIG. 1 is an illustration from a perspective view of one embodiment of the invention. A play yard 100 is illustrated with a play yard liner 102 covering the play yard. The play yard liner 102 features a back wall liner 104, front wall liner 106, and two side wall liners 108. At the top of the wall liners, the wall liners feature an upper reinforcing section 110 that strengthens the top of the wall liners. Also, in various embodiments of the invention, the upper reinforcing section 110 features elastic materials in order to help attach the play yard liner 102 to the play yard 100. In various embodiments of the invention, the upper reinforcing section 110 features curved extensions 112 in order to mate to the shape of the play yard 100. The play yard liner 102 further features a lower reinforcing section 114 in order to support the lower portions of the wall liners. The play yard liner 102 further features vertical reinforcing sections 116 at the areas of the play yard liner adjacent to the play yard's 100 columns. In order to allow parents to view babies while inside the play yard 100, the play yard liner 102 features a plurality of mesh openings 118 that protect the baby while allowing outsiders to visually observe the baby. The play yard liner 102 features a plurality of straps 120 that attach to the columns 122 of the play yard 100.

Figure 2:
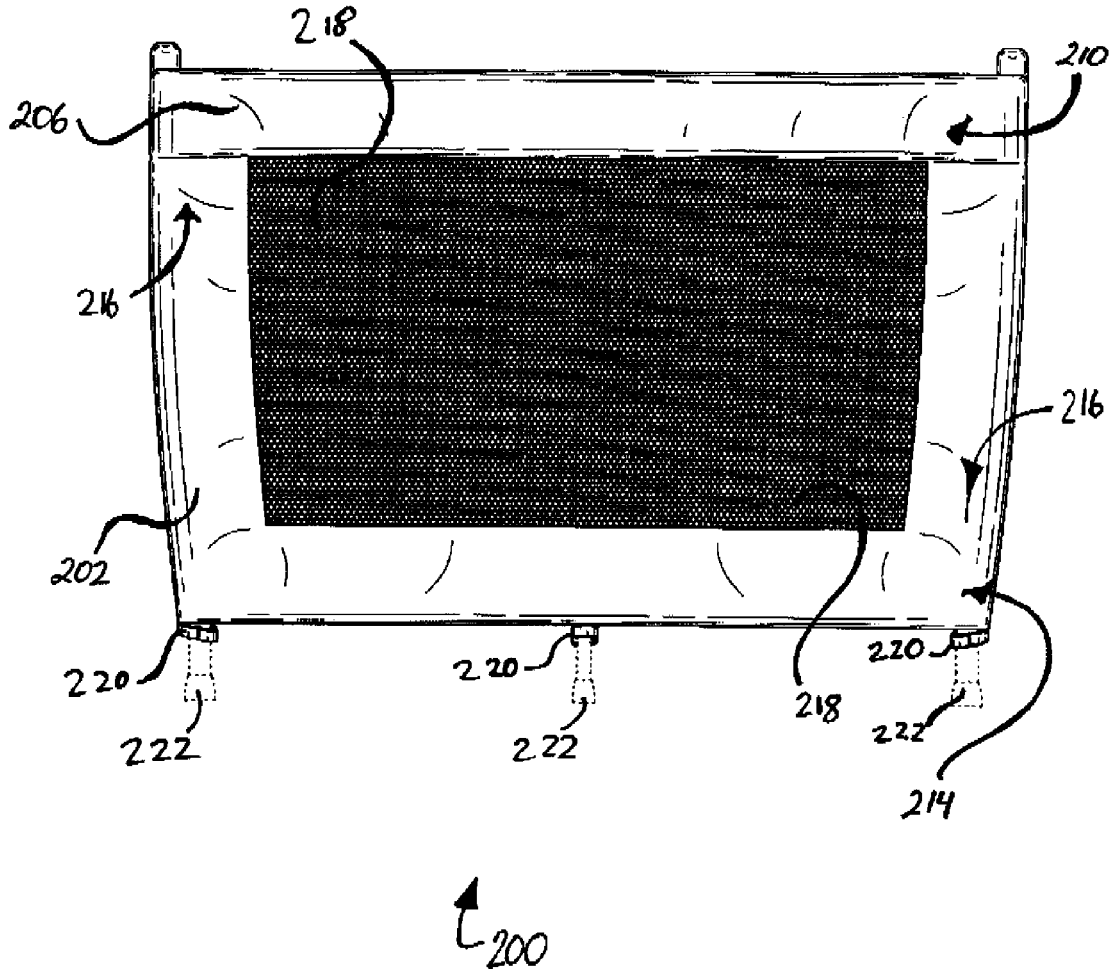
FIG. 2 is an illustration from a side view of one embodiment of the invention.

FIG. 2 is an illustration from a side view of one embodiment of the invention. A play yard 200 is illustrated with a play yard liner 202 covering the play yard from the perspective adjacent to the side wall liner 206. At the top of the side wall liner 206, the wall liner features an upper reinforcing section 210 that strengthens the top of the wall liners. The play yard liner 202 further features a lower reinforcing section 214 in order to support the lower portions of the wall liners. The play yard liner 202 further features vertical reinforcing sections 216 at the areas of the play yard liner 202 adjacent to the play yard's 200 columns. In order to allow parents to view babies while inside the play yard 200, the play yard liner 202 features a plurality of mesh openings 218 that protect the baby while allowing outsiders to visually observe the baby through the side wall liner 206. The play yard liner 202 features a plurality of straps 220 that attach to the columns 222 of the play yard 200.

Figure 3:
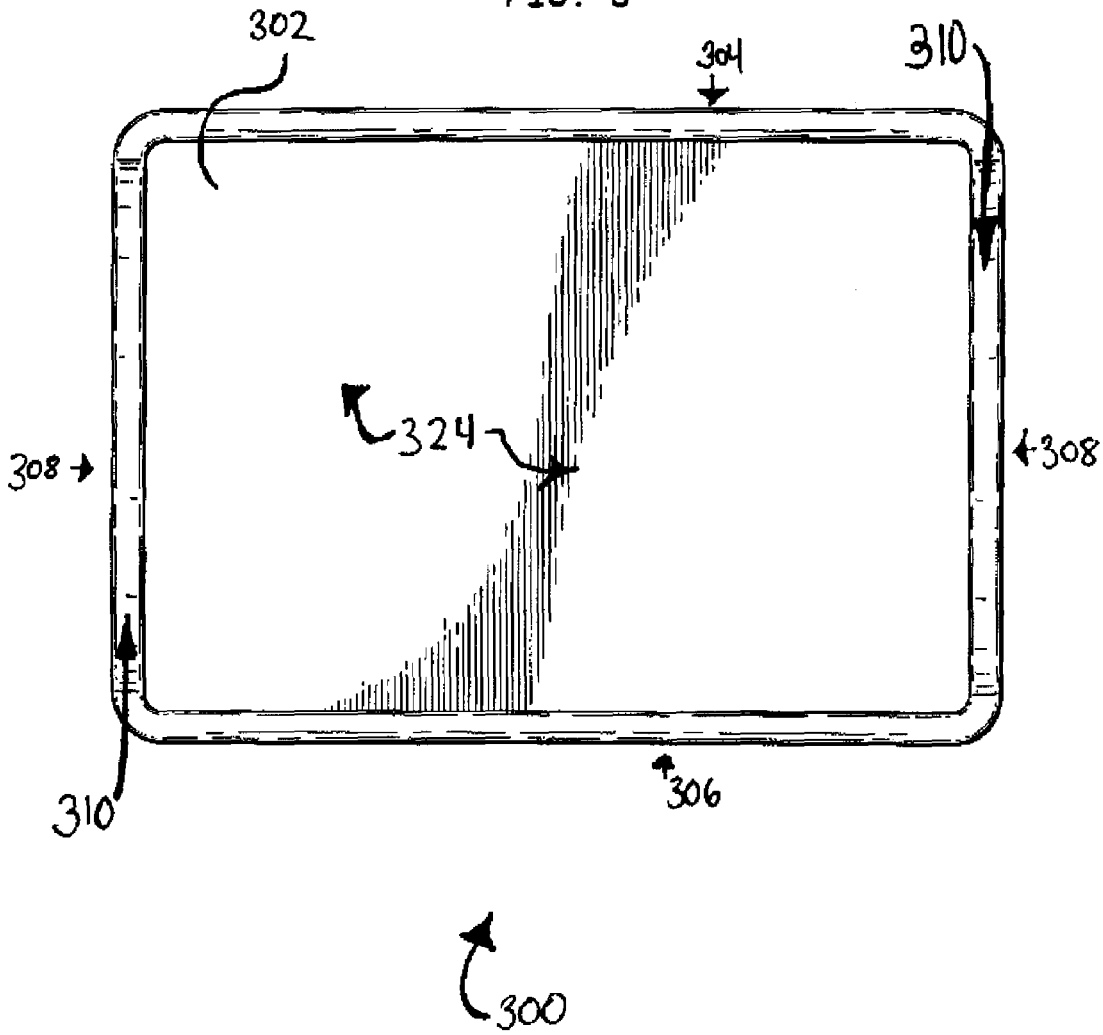
FIG. 3 is an illustration from a top view of one embodiment of the invention.

FIG. 3 is an illustration from a top view of one embodiment of the invention. A play yard 300 is illustrated with a play yard liner 302 covering the play yard. The play yard liner 302 features a bottom liner 324 that covers the bottom portion of the play yard 300. In various embodiments of the invention, the bottom liner 324 is comprised of a resilient or washable material, in order to protect the play yard 300 from being soiled by babies playing within the play yard 300. The play yard liner 302 features a back wall liner 304, front wall liner 306, and two side wall liners 308. At the top of the wall liners, the wall liners feature an upper reinforcing section 310 that strengthens the top of the wall liners.

What is claimed is:

1. A re-attachable play yard liner, in combination with a corresponding play yard to which the liner is adapted to be releasably attached, the liner comprising:

a bottom cover, said bottom cover being configured to substantially match the size and shape of the floor of a play yard and to cover the floor of the play yard, a plurality of wall covers, said plurality of wall covers being configured to substantially match the size and shape of the play yard walls and to attach to said bottom cover at the base of said plurality of wall covers, said plurality of wall covers comprising an inner wall cover and an outer wall cover, said inner wall covers being configured to cover the inner walls of the play yard and comprising a mesh window and a plurality of reinforcing sections, said outer wall covers being configured to cover the outer walls of the play yard and comprising a mesh window and a plurality of reinforcing sections, said inner wall reinforcing sections and said outer wall reinforcing sections comprising an upper reinforcing section, a lower reinforcing section, and a plurality of vertical reinforcing sections, said upper reinforcing sections being configured to circumscribe the top of the play yard walls, said lower reinforcing sections being configured to circumscribe the bottom of the play yard walls, and said plurality of vertical reinforcing sections being located adjacent to the corners of the play yard walls, all said reinforcing sections comprising an elastic material, whereby the liner can be securely attached to the corresponding play yard.

2. A re-attachable play yard liner according to claim 1, wherein said reinforcing sections comprise a water resistant material.

3. A re-attachable play yard liner according to claim 1, wherein said re-attachable play yard liner comprises materials that are washing machine washable.

4. A re-attachable play yard liner according to claim 1, further comprising a plurality of straps, said straps being configured to attach said re-attachable play yard liner to a play yard.

5. A re-attachable play yard liner according to claim 4, wherein said straps attach said re-attachable play yard liner to a play yard with fasteners selected from one of the following types of fasteners: buttons, snap buttons, hook-and-loop fasteners, hooks, or zippers.

6. A re-attachable play yard liner according to claim 1, wherein said re-attachable play yard liner comprises four wall covers that are configured to cover the walls in a rectangular shaped play yard.

7. A washing machine washable re-attachable play yard liner, in combination with a corresponding play yard to which the linear is adapted to be releasably attached, the linear comprising:

a bottom cover, said bottom cover being configured to substantially match the size and shape of the floor of a play yard and to cover the floor of the play yard, a plurality of wall covers, said plurality of wall covers being configured to substantially match the size and shape of the play yard walls and to attach to said bottom cover at the base of said plurality of wall covers, said plurality of wall covers comprising an inner wall cover and an outer wall cover, said inner wall covers being configured to cover the inner walls of the play yard and comprising a mesh window and a plurality of reinforcing sections, said outer wall covers being configured to cover the outer walls of the play yard and comprising a mesh window and a plurality of reinforcing sections, said inner wall reinforcing sections and said outer wall reinforcing sections comprising an elastic material and a water resistant material and further comprising an upper reinforcing section, a lower reinforcing section, and a plurality of vertical reinforcing sections, said upper reinforcing sections being configured to circumscribe the top of the play yard walls, said lower reinforcing sections being configured to circumscribe the bottom of the play yard walls, said plurality of vertical reinforcing sections being located adjacent to the corners of the play yard walls, a plurality of straps, said plurality of straps being configured to attach said re-attachable play yard liner to a play yard, all said reinforcing sections comprising an elastic material, whereby the linear can be securely attached to the corresponding play yard.

8. A washing machine washable re-attachable play yard liner according to claim 7, wherein said plurality of straps attach said re-attachable play yard liner to a play yard with fasteners selected from one of the following types of fasteners: buttons, snap buttons, hook-and-loop fasteners, hooks, or zippers.

9. A washing machine washable re-attachable play yard liner according to claim 7, wherein said re-attachable play yard liner comprises four wall covers that are configured to cover walls in a rectangular shaped play yard.

* * * * *